US007992493B2

(12) United States Patent
Yamamoto

(10) Patent No.: US 7,992,493 B2
(45) Date of Patent: Aug. 9, 2011

(54) DAMPENING WATER CONTROL METHOD AND PRINTING APPARATUS

(75) Inventor: Takaharu Yamamoto, Kyoto (JP)

(73) Assignee: Dainippon Screen MFG Co., Ltd., Kyoto (JP)

( * ) Notice: Subject to any disclaimer, the term of this patent is extended or adjusted under 35 U.S.C. 154(b) by 673 days.

(21) Appl. No.: 11/332,196

(22) Filed: Jan. 17, 2006

(65) Prior Publication Data

US 2006/0162590 A1 Jul. 27, 2006

(30) Foreign Application Priority Data

Jan. 26, 2005 (JP) ..... 2005-018171

(51) Int. Cl.
*B41F 33/00* (2006.01)

(52) U.S. Cl. ..... 101/484; 101/450.1

(58) Field of Classification Search ..... 101/147, 101/148, 350.1, 450.1, 484, 483, 451
See application file for complete search history.

(56) References Cited

U.S. PATENT DOCUMENTS

| | | | | |
|---|---|---|---|---|
| 4,677,298 | A | 6/1987 | Zelmanovic | |
| 4,745,953 | A * | 5/1988 | Kobayashi et al. | 141/1 |
| 5,258,925 | A | 11/1993 | Maier et al. | |
| 6,601,512 | B2 | 8/2003 | Yamamoto | |
| 6,796,227 | B1 | 9/2004 | Miller | |
| 2002/0139272 | A1 * | 10/2002 | Yamamoto et al. | 101/484 |
| 2004/0159254 | A1 * | 8/2004 | Mogi et al. | 101/484 |
| 2004/0226469 | A1 | 11/2004 | Yamamoto et al. | |

FOREIGN PATENT DOCUMENTS

| | | | |
|---|---|---|---|
| EP | 1 245 388 | A1 | 2/2002 |
| EP | 1 477 314 | A1 | 11/2004 |
| JP | 04-103351 | | 6/1992 |
| JP | 7-266547 | | 10/1995 |
| JP | 2831107 | | 9/1998 |
| JP | 11-268231 | | 10/1999 |
| JP | 2002-355950 | A | 10/2002 |

OTHER PUBLICATIONS

European Search Report issued in European Patent Application No. 06000937.0-2304 dated on Feb. 5, 2009.

* cited by examiner

*Primary Examiner* — Daniel J Colilla
*Assistant Examiner* — David Banh
(74) *Attorney, Agent, or Firm* — McDermott Will & Emery LLP

(57) ABSTRACT

Line patches m and solid patches s are printed with a subject image, each line patches having at least 200 lines per inch and a duty ratio of at least 60%, to detect densities Dm and Ds. A water coefficient W (=Dm/Ds) is calculated from the detected densities Dm and Ds. Whether dampening water is fed at a proper rate or not is determined based on correlation data stored beforehand and showing a relationship between the feed rate of dampening water and the water coefficient W. The feed rate of dampening water is controlled to be a proper rate.

4 Claims, 10 Drawing Sheets

DAMPENING WATER CONTROL METHOD AND PRINTING APPARATUS

BACKGROUND OF THE INVENTION

1. Field of the Invention

This invention relates to a dampening water control method and a printing apparatus for use in a lithographic printing that uses dampening water.

2. Description of the Related Art

In a lithographic printing that uses dampening water, the feed rate of dampening water is known to influence print quality. In actual practice, generally, the operator of the printing apparatus visually checks prints, and empirically determines a feed rate of dampening water. In one conventional technique, a film thickness of dampening water on the surface of a printing plate or a dampening water roller is measured, and control is carried out to maintain the film thickness constant.

In view of the above situation, Applicants herein have developed an apparatus for printing, along with a subject image, detecting patches that show density variations occurring with variations in dampening water, and controlling the feed rate of dampening water while measuring densities of the detecting patches (e.g. Japanese Unexamined Patent Publication No. 2002-355950).

The above prior apparatus is capable of automatically controlling the feed rate of dampening water by measuring the densities of the detecting patches. This provides an advantage of assuring a proper feed rate of dampening water without relying on the operator's experience as was the case previously. However, the above prior apparatus has drawbacks of requiring a relatively complicated computation, and providing only a small range of density variations of the detecting patches, to render the control difficult.

SUMMARY OF THE INVENTION

The object of this invention, therefore, is to provide a dampening water control method and a printing apparatus which increase density variations of the detecting patches for improving control sensitivity, thereby controlling the feed rate of dampening water with high accuracy.

The above object is fulfilled, according to this invention, by a dampening water control method for use in a lithographic printing that uses dampening water, for controlling a feed rate of dampening water based on densities of detecting patches printed with a subject image, each of the detecting patches being one of line patches and dot patches having at least 200 lines per inch and an image duty ratio of at least 60%, the method comprising a preparatory step for printing the detecting patches, determining a relation between the densities of the detecting patches and the feed rate of dampening water, and storing the relation as correlation data; a printing step for printing images of the detecting patches as added to the subject image; a measuring step for measuring densities of the detecting patches from a print obtained in the printing step; and a control step for controlling the feed rate of dampening water by using the densities of the detecting patches obtained in the measuring step and the correlation data.

With this dampening water control method, the detecting patches having lines or dots show greater density variations occurring with variations in the feed rate of dampening water, than in the prior art. Thus, dampening water control may be carried out with increased accuracy.

In a preferred embodiment, each of the line patches or dot patches has at least 300 lines per inch, and an image duty ratio of 60% to 90% according to the number of lines.

In another aspect of the invention, a dampening water control method is provided for use in a lithographic printing that uses dampening water, for controlling a feed rate of dampening water based on densities of a first detecting patch and a second detecting patch printed with a subject image, the first detecting patch being a solid patch, and the second detecting patch being one of a line patch and a dot patch having at least 200 lines per inch and an image duty ratio of at least 60%, the method comprising a preparatory step for printing the first and second detecting patches, determining a relation between a ratio of density of the first detecting patch and density of the second detecting patch and the feed rate of dampening water, and storing the relation as correlation data; a printing step for printing images of the first detecting patch and the second detecting patch as added to the subject image; a measuring step for measuring densities of the first detecting patch and the second detecting patch from a print obtained in the printing step; a calculating step for calculating a ratio of the density of the first detecting patch and the density of the second detecting patch; and a control step for controlling the feed rate of dampening water by using the ratio of the density of the first detecting patch and the density of the second detecting patch, and the correlation data.

In a further aspect of the invention, a printing apparatus is provided for use in a lithographic printing that uses dampening water, for controlling a feed rate of dampening water based on densities of detecting patches printed with a subject image, each of the detecting patches being one of line patches and dot patches having at least 200 lines per inch and an image duty ratio of at least 60%. The apparatus comprises a storage device for printing the detecting patches, determining a relation between the densities of the detecting patches and the feed rate of dampening water, and storing the relation as correlation data; a measuring device for measuring densities of the detecting patches printed on a print; and a control unit for controlling the feed rate of dampening water by using the densities of the detecting patches measured and the correlation data.

Other features and advantages of the invention will be apparent from the following detailed description of the embodiments of the invention.

BRIEF DESCRIPTION OF THE DRAWINGS

For the purpose of illustrating the invention, there are shown in the drawings several forms which are presently preferred, it being understood, however, that the invention is not limited to the precise arrangement and instrumentalities shown.

DESCRIPTION OF THE PREFERRED EMBODIMENTS

Figure 1:
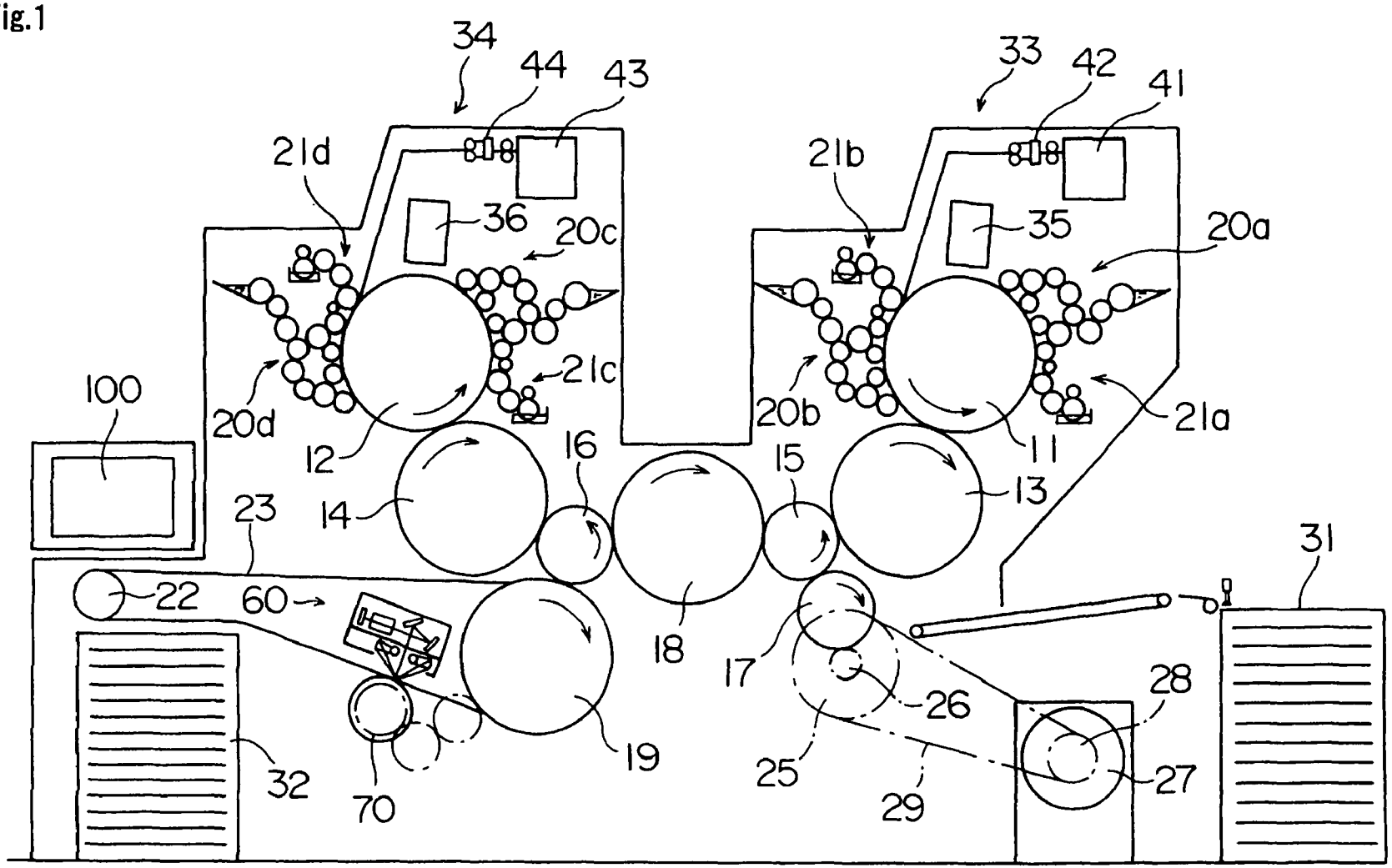
FIG. 1 is a schematic view of a printing apparatus according to this invention.

An embodiment of this invention will be described hereinafter with reference to the drawings. The construction of a printing apparatus according to this invention will be described first. FIG. 1 is a schematic view of the printing apparatus according to this invention.

This printing apparatus records images on blank plates mounted on first and second plate cylinders 11 and 12 in a prepress process, feeds inks to the plates having the images recorded thereon, and transfers the inks from the plates through first and second blanket cylinders 13 and 14 to printing paper held on first and second impression cylinders 15 and 16, thereby printing the images in four colors on the printing paper.

The printing apparatus has the first plate cylinder 11, the second plate cylinder 12, the first blanket cylinder 13 contactable with the first plate cylinder 11, the second blanket cylinder 14 contactable with the second plate cylinder 12, the first impression cylinder 15 contactable with the first blanket cylinder 13, and the second impression cylinder 16 contactable with the second blanket cylinder 14. The printing apparatus further includes a paper feed cylinder 17 for transferring printing paper supplied from a paper storage station 31 to the first impression cylinder 15, a transfer cylinder 18 for transferring the printing paper from the first impression cylinder 15 to the second impression cylinder 16, a paper discharge cylinder 19 with chains 23 wound thereon and extending to and wound on sprockets 22 for discharging printed paper from the second impression cylinder 16 to a paper discharge station 32, an image pickup station 60 for reading images and measuring densities of detecting patches printed on the printing paper, and a control panel 100 of the touch panel type.

Each of the first and second plate cylinders 11 and 12 is what is called a two-segmented cylinder for holding two printing plates peripherally thereof for printing in two different colors. The first and second blanket cylinders 13 and 14 have the same diameter as the first and second plate cylinders 11 and 12, and each has blanket surfaces for transferring images in two colors.

The first and second impression cylinders 15 and 16 movable into contact with the first and second blanket cylinders 13 and 14, respectively, have half the diameter of the first and second plate cylinders 11 and 12 and the first and second blanket cylinders 13 and 14. The first and second impression cylinders 15 and 16 have grippers, not shown, for holding and transporting the forward end of printing paper.

The paper feed cylinder 17 disposed adjacent the impression cylinder 15 has the same diameter as the first and second impression cylinders 15 and 16. The paper feed cylinder 17 has a gripper, not shown, for holding and transporting, with each intermittent rotation of the feed cylinder 17, the forward end of each sheet of printing paper fed from the paper storage station 31. When the printing paper is transferred from the feed cylinder 17 to the first impression cylinder 15, the gripper of the first impression cylinder 15 holds the forward end of the printing paper which has been held by the gripper of the feed cylinder 17.

The transfer cylinder 18 disposed between the first impression cylinder 15 and second impression cylinder 16 has the same diameter as the first and second plate cylinders 11 and 12 and the first and second blanket cylinders 13 and 14. The transfer cylinder 18 has a gripper, not shown, for holding and transporting the forward end of the printing paper received from the first impression cylinder 15, and transferring the forward end of the printing paper to the gripper of the second impression cylinder 16.

Figure 2:
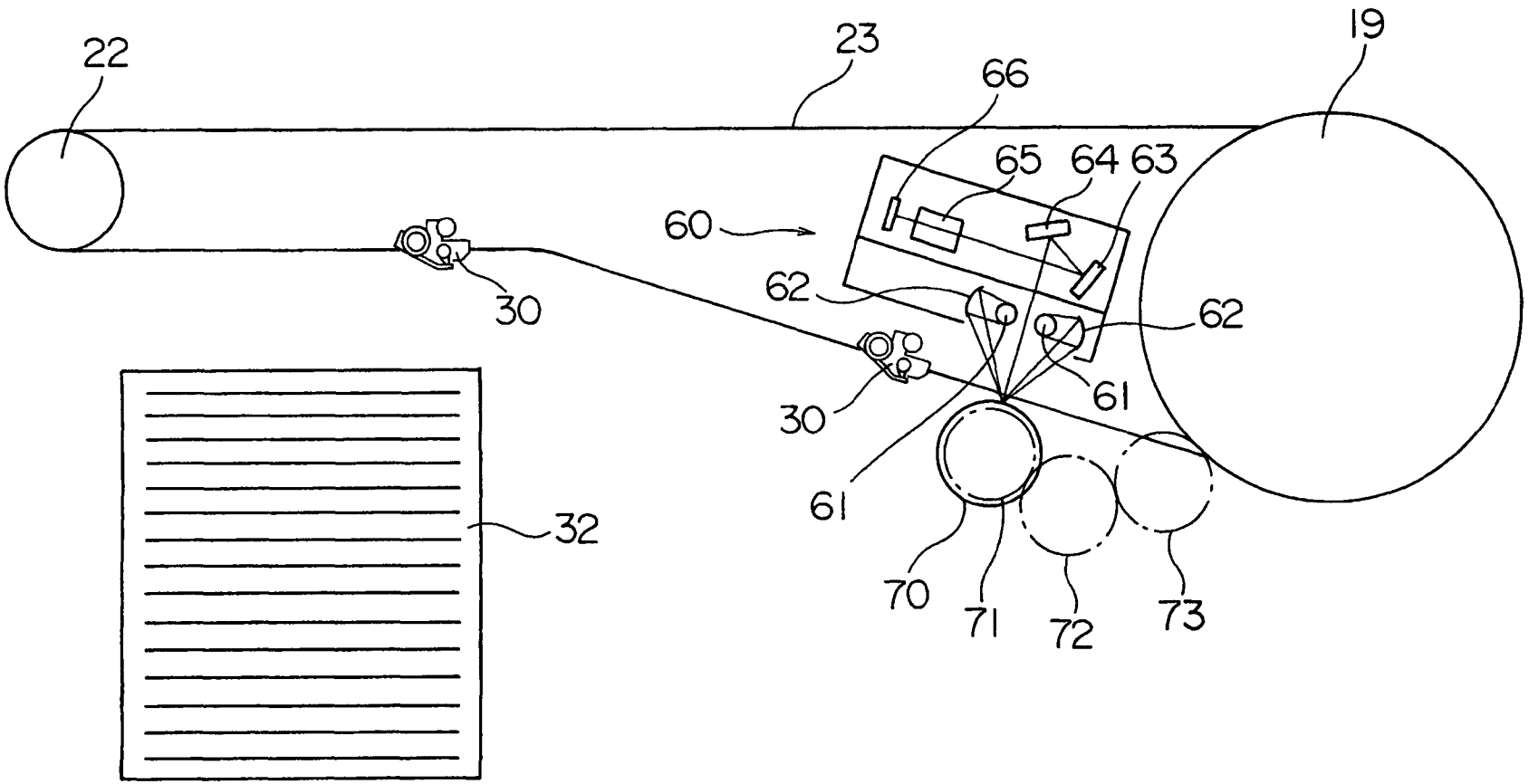
FIG. 2 is a schematic side view showing an image pickup station along with a paper discharge mechanism such as a paper discharge cylinder.

The paper discharge cylinder 19 disposed adjacent the second impression cylinder 16 has the same diameter as the first and second plate cylinders 11 and 12 and the first and second blanket cylinders 13 and 14. The discharge cylinder 19 has a pair of chains 23 wound around opposite ends thereof. The chains 23 are interconnected by coupling members, not shown, having a plurality of grippers 30 arranged thereon (FIG. 2). When the second impression cylinder 16 transfers the printing paper to the discharge cylinder 19, one of the grippers 30 on the discharge cylinder 17 holds the forward end of the printing paper having been held by the gripper of the second impression cylinder 16. With movement of the chains 23, the printing paper is transported to the paper discharge station 32 to be discharged thereon.

The paper feed cylinder 17 has a gear attached to an end thereof and connected to a gear 26 disposed coaxially with a driven pulley 25. A belt 29 is wound around and extends between the driven pulley 25 and a drive pulley 28 rotatable by a motor 27. Thus, the paper feed cylinder 17 is rotatable by drive of the motor 27. The first and second plate cylinders 11 and 12, first and second blanket cylinders 13 and 14, first and second impression cylinders 15 and 16, paper feed cylinder 17, transfer cylinder 18 and paper discharge cylinder 19 are coupled to one another by gears attached to ends thereof, respectively. Thus, by the drive of motor 27, the paper feed cylinder 17, first and second impression cylinders 15 and 16, paper discharge cylinder 19, first and second blanket cylinders 13 and 14, first and second plate cylinders 11 and 12 and transfer cylinder 18 are rotatable synchronously with one another.

The first plate cylinder 11 is surrounded by an ink feeder 20*a* for feeding an ink of black (K), for example, to a plate, an ink feeder 20*b* for feeding an ink of cyan (C), for example, to a plate, and dampening water feeders 21*a* and 21*b* for feeding dampening water to the plates. The second plate cylinder 12 is surrounded by an ink feeder 20*c* for feeding an ink of magenta (M), for example, to a plate, an ink feeder 20*d* for feeding an ink of yellow (Y), for example, to a plate, and dampening water feeders 21*c* and 21*d* for feeding dampening water to the plates.

Further, arranged around the first and second plate cylinders 11 and 12 are a plate feeder 33 for feeding plates to the peripheral surface of the first plate cylinder 11, a plate feeder 34 for feeding plates to the peripheral surface of the second plate cylinder 12, an image recorder 35 for recording images on the plates mounted peripherally of the first plate cylinder 11, and an image recorder 36 for recording images on the plates mounted peripherally of the second plate cylinder 12.

FIG. 2 is a schematic side view showing the image pickup station 60 for reading images and measuring densities of detecting patches printed on the printing paper, along with the paper discharge mechanism such as the paper discharge cylinder 19.

The pair of chains 23 are endlessly wound around the opposite ends of the paper discharge cylinder 19 and the pair of sprockets 22. As noted hereinbefore, the chains 23 are interconnected by coupling members, not shown, having a plurality of grippers 30 arranged thereon each for gripping the forward end of printing paper transported. FIG. 5 shows only two grippers 30, with the other grippers 30 omitted.

The pair of chains 23 have a length corresponding to a multiple of the circumference of first and second impression cylinders 15 and 16. The grippers 30 are arranged on the chains 23 at intervals each corresponding to the circumference of first and second impression cylinders 15 and 16. Each gripper 30 is opened and closed by a cam mechanism, not shown, synchronously with the gripper on the paper discharge cylinder 19. Thus, each gripper 30 receives the printing paper from the paper discharge cylinder 19, transports the printing paper with rotation of the chains 23, and is then opened by the cam mechanism, not shown, to discharge the paper on the paper discharge station 32.

The printing paper is transported with only the forward end thereof held by one of the grippers 30, the rear end of printing paper not being fixed. Consequently, the printing paper could flap during transport, which impairs an operation, to be described hereinafter, of the image pickup station 60 to read images and measure densities of the detecting patches. To avoid such an inconvenience, this printing apparatus provides a suction roller 70 disposed upstream of the paper discharge station 32 for stabilizing the printing paper transported.

The suction roller 70 is in the form of a hollow roller having a surface defining minute suction bores, with the hollow interior thereof connected to a vacuum pump not shown. The suction roller 70 has a gear 71 attached to an end thereof. The gear 71 is connected through idler gears 72 and 73 to the gear attached to an end of the paper discharge cylinder 19. Consequently, the suction roller 43 is driven to rotate in a matching relationship with a moving speed of the grippers 30. Thus, the printing paper is sucked to the surface of the suction roller 70, thereby being held against flapping when passing over the suction roller 70. In place of the suction roller 70, a suction plate may be used to suck the printing paper two-dimensionally.

The above image pickup station 60 includes a pair of linear light sources 61 extending parallel to the suction roller 70 for illuminating the printing paper on the suction roller 70, a pair of condensing plates 62, reflecting mirrors 63 and 64, a condensing lens 65 and a CCD line sensor 66. The printing paper transported by the paper discharge mechanism including the paper discharge cylinder 19 and chains 23 is illuminated by the pair of linear light sources 61, and photographed by the CCD line sensor 66. The image of the printing paper and density data are displayed on the control panel 100 of the touch panel type.

Figure 3:
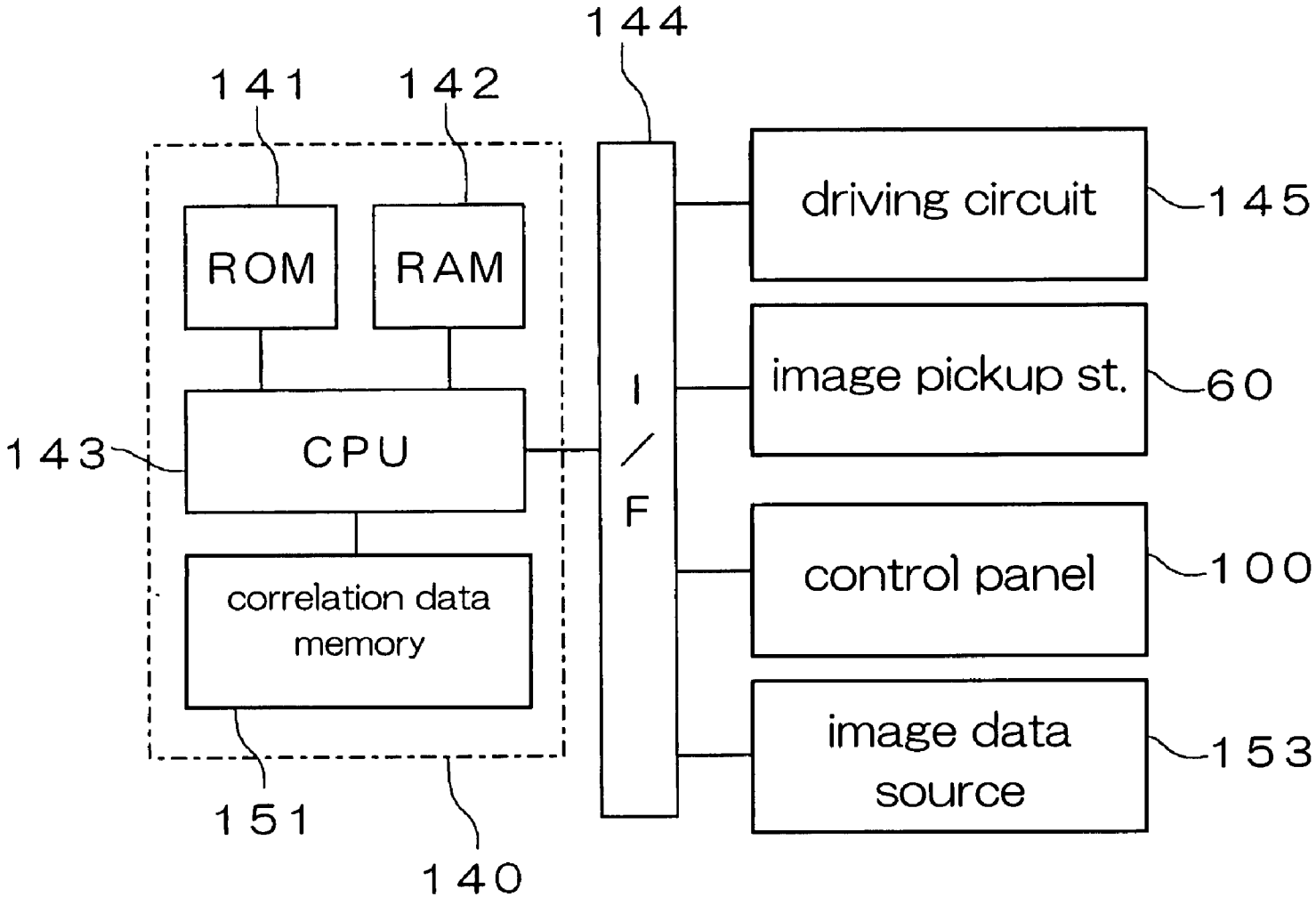
FIG. 3 is a block diagram of a principal electrical structure of the printing apparatus.

FIG. 3 is a block diagram showing a principal electrical structure of the printing apparatus. This printing apparatus includes a control unit 140 having a ROM 141 for storing operating programs necessary for controlling the apparatus, a RAM 142 for temporarily storing data and the like during a control operation, and a CPU 143 for performing logic operations. The control unit 140 has a driving circuit 145 connected thereto through an interface 144, for generating driving signals for driving the ink feeders 20, dampening water feeders 21, image recorders 35 and 36, the contact mechanisms for the first and second blanket cylinders 13 and 14, and so on. The printing apparatus is controlled by the control unit 140 to execute prepress and printing operations as described hereinafter.

The control unit 140 includes a correlation data memory 151 described hereinafter. The control unit 140 is connected also to the image pickup station 60 and control panel 100 through the interface 144. Further, the control unit 140 is connected also to an image data source 153 described hereinafter, such as an image processing apparatus constituting a stage preceding this printing apparatus.

In the printing apparatus having the above construction, a printing plate stock drawn from a supply cassette 41 of the plate feeder 33 is cut to a predetermined size by a cutter 42. The forward end of each plate in cut sheet form is guided by guide rollers and guide members, not shown, and is clamped by clamps of the first plate cylinder 11. Then, the first plate cylinder 11 is driven by a motor, not shown, to rotate at low speed, whereby the plate is wrapped around the peripheral surface of the first plate cylinder 11. The rear end of the plate is clamped by other clamps of the first plate cylinder 11. While, in this state, the first plate cylinder 11 is rotated at high speed, the image recorder 35 irradiates the surface of the plate mounted peripherally of the first plate cylinder 11 with a modulated laser beam for recording an image thereon.

Similarly, a printing plate stock drawn from a supply cassette 43 of the plate feeder 34 is cut to the predetermined size by a cutter 44. The forward end of each plate in cut sheet form is guided by guide rollers and guide members, not shown, and is clamped by clamps of the second plate cylinder 12. Then, the second plate cylinder 12 is driven by a motor, not shown, to rotate at low speed, whereby the plate is wrapped around the peripheral surface of the second plate cylinder 12. The rear end of the plate is clamped by other clamps of the second plate cylinder 12. While, in this state, the second plate cylinder 12 is rotated at high speed, the image recorder 36 irradiates the surface of the plate mounted peripherally of the second plate cylinder 12 with a modulated laser beam for recording an image thereon.

The first plate cylinder 11 has, mounted peripherally thereof, a plate for printing in black ink and a plate for printing in cyan ink. The two plates are arranged in evenly separated positions (i.e. in positions separated from each other by 180 degrees). The image recorder 35 records images on these plates. Similarly, the second plate cylinder 12 has, mounted peripherally thereof, a plate for printing in magenta ink and a plate for printing in yellow ink. The two plates also are arranged in evenly separated positions, and the image recorder 36 records images on these plates, to complete a prepress process.

The prepress process is followed by a printing process for printing the printing paper with the plates mounted on the first and second plate cylinders 11 and 12. This printing process is carried out as follows.

First, each dampening water feeder 21 and each ink feeder 20 are placed in contact with only a corresponding one of the plates mounted on the first and second plate cylinders 11 and 12. Consequently, dampening water and inks are fed to the plates from the corresponding water feeders 21 and ink feeders 20, respectively. These inks are transferred from the plates to the corresponding regions of the first and second blanket cylinders 13 and 14, respectively.

Then, the printing paper is fed to the paper feed cylinder 17. The printing paper is subsequently passed from the paper feed cylinder 17 to the first impression cylinder 15. The impression cylinder 15 having received the printing paper continues to rotate. Since the first impression cylinder 15 has half the diameter of the first plate cylinder 11 and the first blanket cylinder 13, the black ink is transferred to the printing paper wrapped around the first impression cylinder 15 in its first rotation, and the cyan ink in its second rotation.

After the first impression cylinder 15 makes two rotations, the printing paper is passed from the first impression cylinder 15 to the second impression cylinder 16 through the transfer cylinder 18. The second impression cylinder 16 having received the printing paper continues to rotate. Since the second impression cylinder 16 has half the diameter of the second plate cylinder 12 and the second blanket cylinder 14, the magenta ink is transferred to the printing paper wrapped around the second impression cylinder 16 in its first rotation, and the yellow ink in its second rotation.

The forward end of the printing paper printed in the four colors in this way is passed from the second impression cylinder 16 to the paper discharge cylinder 19. The printing paper is transported by the pair of chains 23 toward the paper discharge station 32 to be discharged thereon. At this time, the detecting patches on the printing paper being transported are illuminated by the pair of linear light sources 61, and are photographed by the CCD line sensor 66. The photographed image is displayed on the control panel 100.

In the printing apparatus in this embodiment, image data obtained by reading images is used also in controlling feed rates of the inks and dampening water. Specifically, the image itself and the detecting patches are read from prints, and image data thereby obtained is used to calculate color densities or color values of the YMCK colors in a pertinent area. The color densities or color values are then compared with predetermined values, e.g. reference color densities or color values made available in advance, to adjust the feeding rates of the inks. A procedure of adjusting a dampening water feed rate using the detecting patches according to this invention will be disclosed hereinafter.

After the printing process, the printing paper printed is discharged. The first and second blanket cylinders 13 and 14 are cleaned by a blanket cylinder cleaning device, not shown, to complete the printing process.

Figure 4:
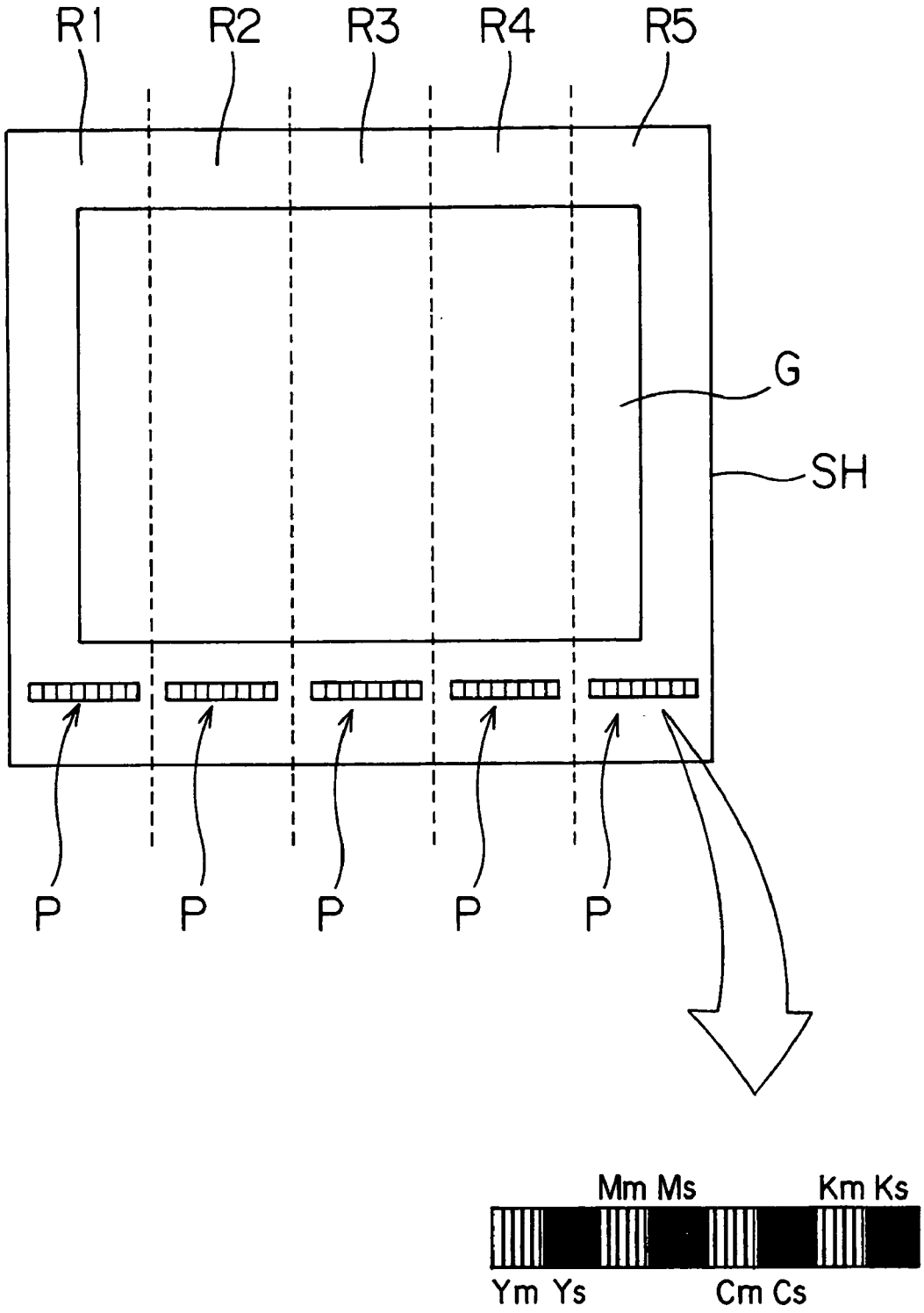
FIG. 4 is an explanatory view schematically showing detecting patches on a print.

Next, the detecting patches according to this invention will be described. FIG. 4 is a schematic view showing a printed image G and detecting patches P on printing paper. FIG. 4 includes an enlarged representation of a detecting patch in a right-hand portion thereof.

In this embodiment, printing paper SH has a plurality of detecting patches P arranged below the printed image G as corresponding to ink key regions R1-R5.

Each detecting patch P, as shown in enlargement, includes solid patches Ys, Ms, Cs and Ks corresponding to the respective colors of YMCK (which will be collectively called solid patch s), and line patches Ym, Mm, Cm and Km corresponding to the respective colors of YMCK (which will be collectively called line patch m). This invention measures density Dm of the line patch m, and determines based on the density Dm whether the feed rate of dampening water is appropriate or not. On the other hand, the density Dm of the line patch m is variable also with the feed rate of ink. In this embodiment, therefore, the influence of changes in the feeding rate of ink is eliminated by standardizing the density Dm of the line patch m with the density Ds of the solid patch s.

Each solid patch s is an image having a print percentage (i.e. the proportion of printing areas to the total area) at 100%. However, the print percentage need not be strictly 100%; a print percentage sufficient for providing a steady density value will serve the purpose. The definition of solid patch s in this invention includes also such patches having print percentages close to "solid".

As noted above, the density Ds of solid patch s is used to standardize the density Dm of line patch m. As long as the feed rate of ink can be maintained at an appropriate value, the solid patch s may be omitted. However, since the feed rate of ink usually is changed during a printing operation, it is desirable to correct density variations of line patch m due to the changes in the feed rate of ink by using the density Ds of solid patch s.

In this embodiment, each line patch m has the number of lines (i.e. the number of lines per inch representing resolution; also called screen ruling) at 200 or more, and has a line pattern with a duty ratio (i.e. the proportion of printing areas to the total area in a periodic pattern) at 60% or more.

The principle of density variations of the line patch m in relation to dampening water will be described. FIGS. 5 and 6 are graphs showing variations in the density Dm of line patch m occurring with changes in dampening water.

Figure 5A:
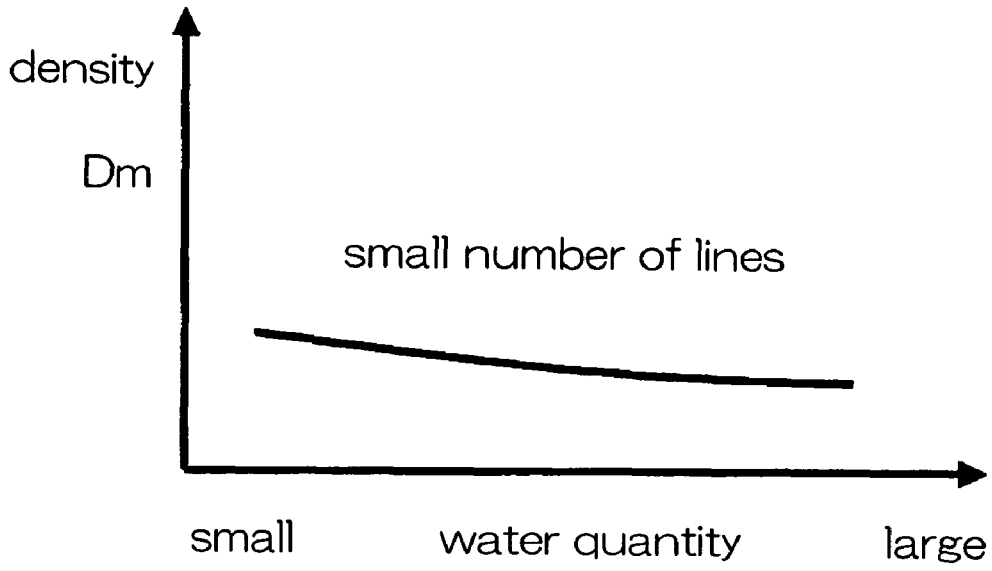
FIG. 5 is an explanatory view schematically showing a relationship between feed rates of dampening water and detecting patches.
Figure 5B:
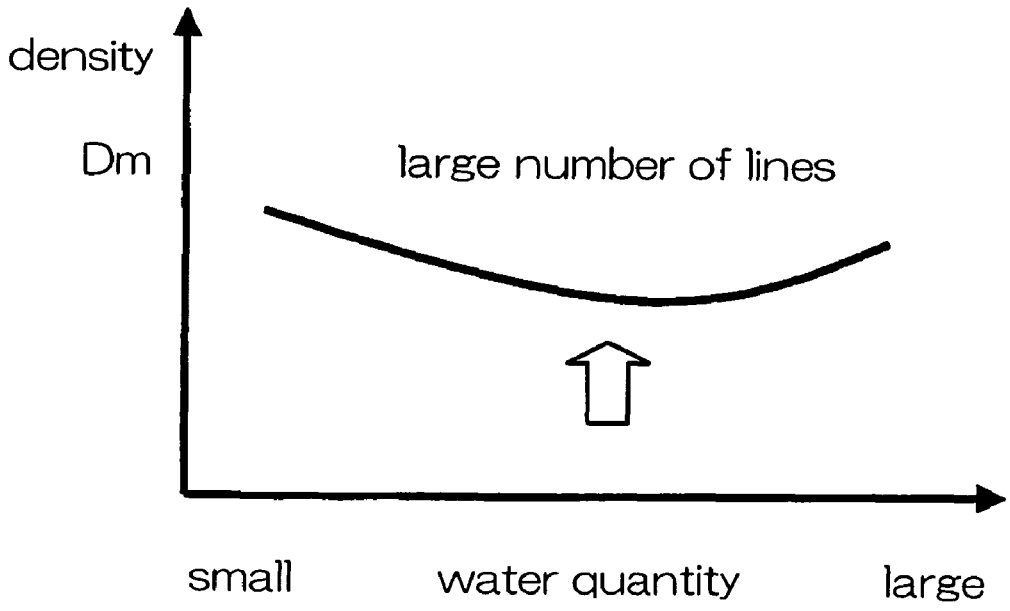

From an experiment carried out by Applicants herein, as shown in FIGS. 5A and 5B, it has been found that the larger number of lines in the line patch m provides the higher density Dm, and the greater variation in the density Dm relative to variations of dampening water. The greater variation in the density Dm of line patch m provides the higher detection accuracy, and is desirable for the control of dampening water. However, with a large number of lines, as shown in FIG. 5B, the graph of a correlation between the feed rate of dampening water and the density Dm of detecting patch m shows a pronounced U-shape. That is, it has been found that the density Dm increases at opposite ends where dampening water is large and small in quantity. Where the correlation describes a U-shape as above, the density Dm and the feed rate of dampening water do not correspond uniquely to each other. This gives rise to a new problem of complicating judgments to be made in controlling dampening water.

Figure 6A:
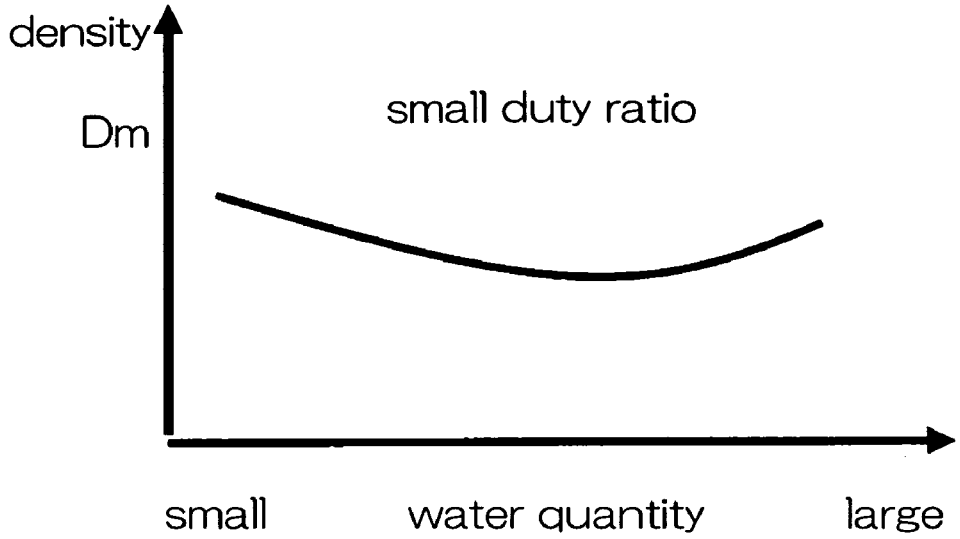
FIG. 6 is an explanatory view schematically showing a relationship between feed rates of dampening water and detecting patches.
Figure 6B:
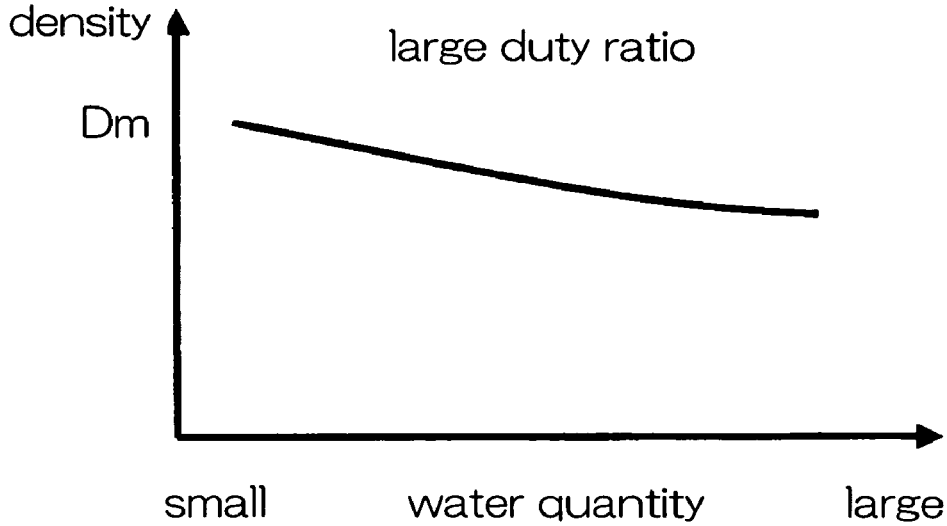

From another experiment carried out by Applicants herein, as shown in FIGS. 6A and 6B, it has been found that a duty ratio of the lines exceeding a certain value further increases the variation in the density Dm, and shifts the shape of the correlation toward the higher feed rate of dampening water, thereby changing the U-shape into a downward inclination. Thus, by increasing the duty ratio in this way, the shape of the correlation can be changed into a shape suitable for control.

Figure 7:
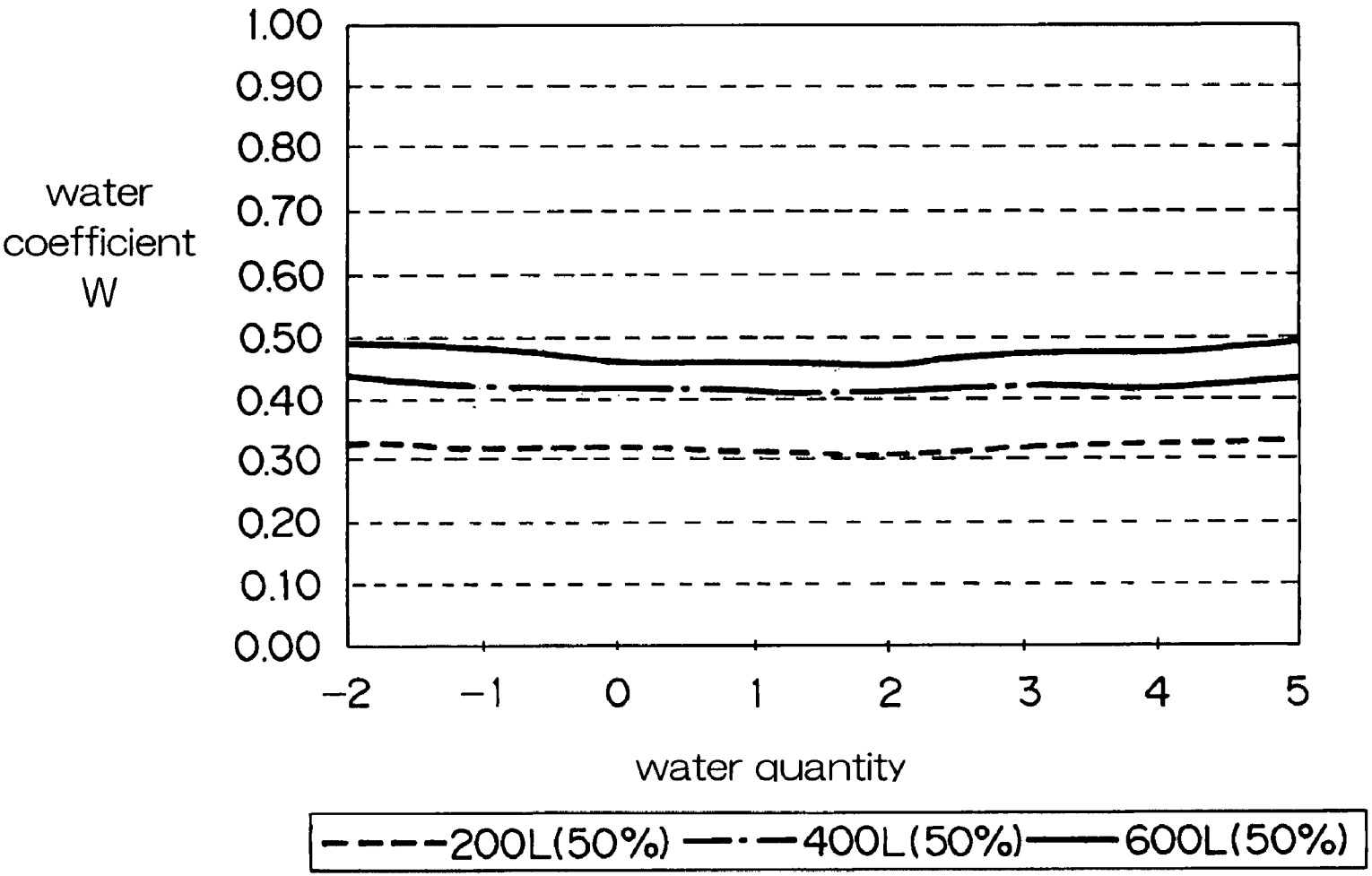
FIG. 7 is experiment data showing a relationship between feed rates of dampening water and water coefficients.
Figure 8:
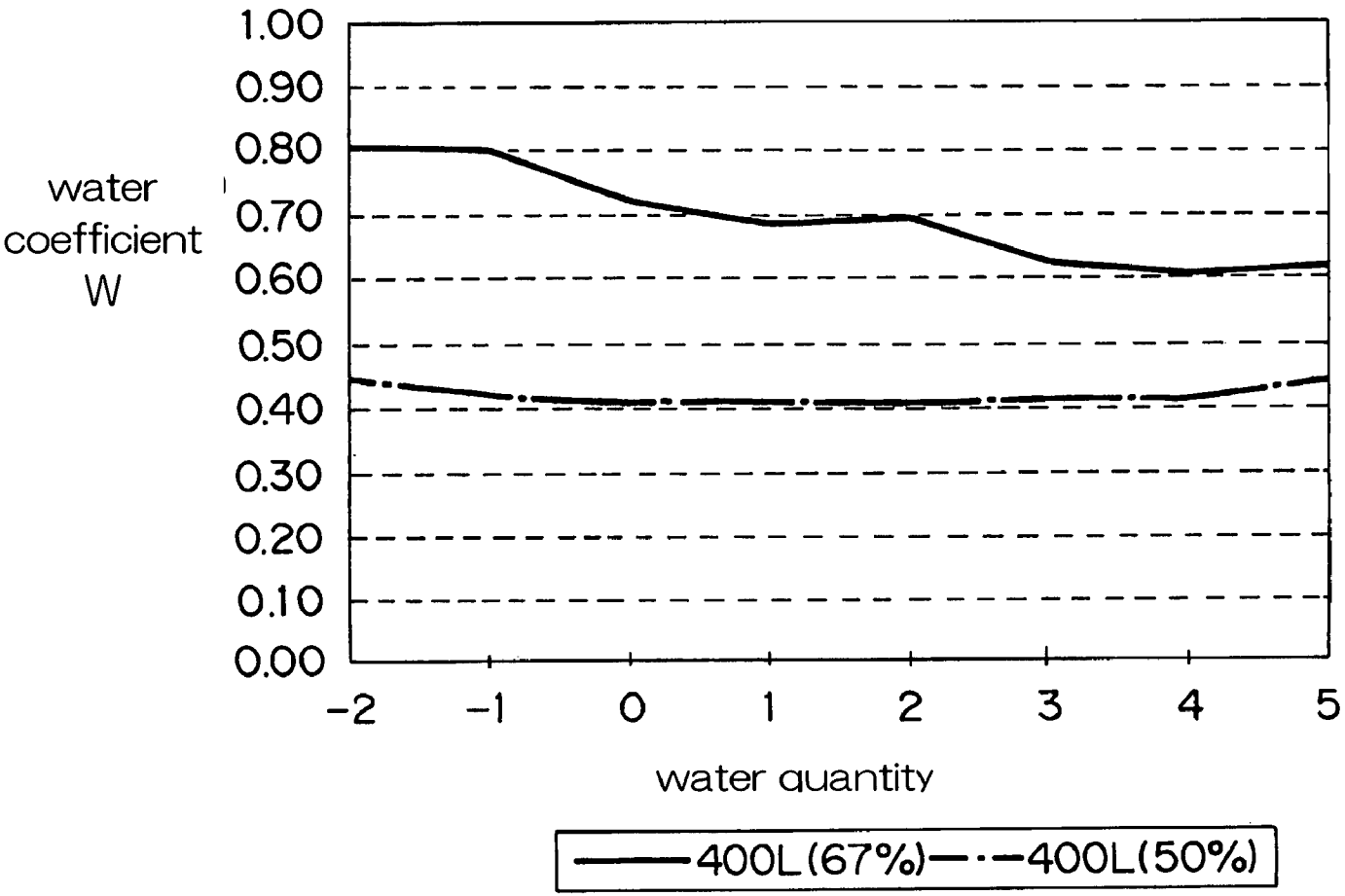
FIG. 8 is experiment data showing a relationship between feed rates of dampening water and water coefficients.

The line patches used in this invention have been determined by taking the above characteristics into consideration. FIGS. 7 and 8 are graphs showing results of experiment conducted with digital offset printing apparatus TruePress344 manufactured by Dainippon Screen Mfg. Co., Ltd. FIG. 7 shows data of a correlation between the feed rate of dampening water and the density Dm of the detecting patches resulting from variations in the number of lines in the line patches. This graph of correlation data differs from what is shown in FIGS. 5 and 6 in that the vertical axis represents the density Dm of line patch m having values divided by the density Ds of solid patch s (hereinafter referred to as water coefficient W), in order to correct the density variations occurring with variations in the ink feed rate as described above. However, the tendency of the graphs is unchanged. It will be seen from this graph that the variation of water coefficient W increases with the number of lines.

FIG. 8 shows a correlation between the feed rate of dampening water and the water coefficient W resulting from variations in the duty ratio of line patches having the same number of lines. As seen from this graph, an increase in the duty ratio increases the variation of water coefficient W, and describes an inclined graph. However, an excessive increase in the duty ratio will render the line patches similar to the solid patches, and therefore the duty ratio should, preferably, not exceed 90%.

The correlation data described above is created as follows. First, the line patch m and solid patch s are printed as affixed to a subject image. For this printing, the operator manually adjusts the feed rates of dampening water and inks and checks the resulting prints. When the operator determines that print quality is proper, he or she regards the quantity of dampening water used at that time as proper (water quantity percent at 0 on the horizontal axis in FIGS. 7 and 8), and plots the corresponding water coefficient W (W=Dm/Ds). Next, the operator varies the feed rate of dampening water up and down for every percent, for example, and plots corresponding water coefficients to complete the correlation data. The variations in the feed rate of dampening water may be effected, for example, by controlling the number of rotations of a water fountain roller where an ordinary dampening water feeder of the continuous water supply type is used.

Various line patches have been tested in relation to a printing material to be used. The results show that, where the number of lines is 200 or more, especially 300 or more, and the duty ratio is set to 60 to 90% according to the number of lines, the correlation data obtained has sufficiently large density variations with respect to dampening water, and that in a gently inclined state. By using this correlation data, the feed rate of dampening water may be controlled with high accuracy.

The above embodiment uses line patches m having vertical lines (extending in the printing direction). Alternatively, line patches used may have lines extending in other directions, such as horizontal lines (extending transversely of the printing direction). Use of halftone dots, instead of lines, has proved to produce similar results. However, where the closer to horizontal (extending transversely of the printing direction) the direction of lines or dots is, the smaller the variations tend to be in response to disturbance such as variations in the feed rates of dampening water and ink, which is effective for control in a relatively stable state. On the other hand, the lines and halftone dots extending or arranged vertically strongly reflect influences of disturbance, which is effective for control in a state of relatively large variations in the feed rate.

Figure 9:
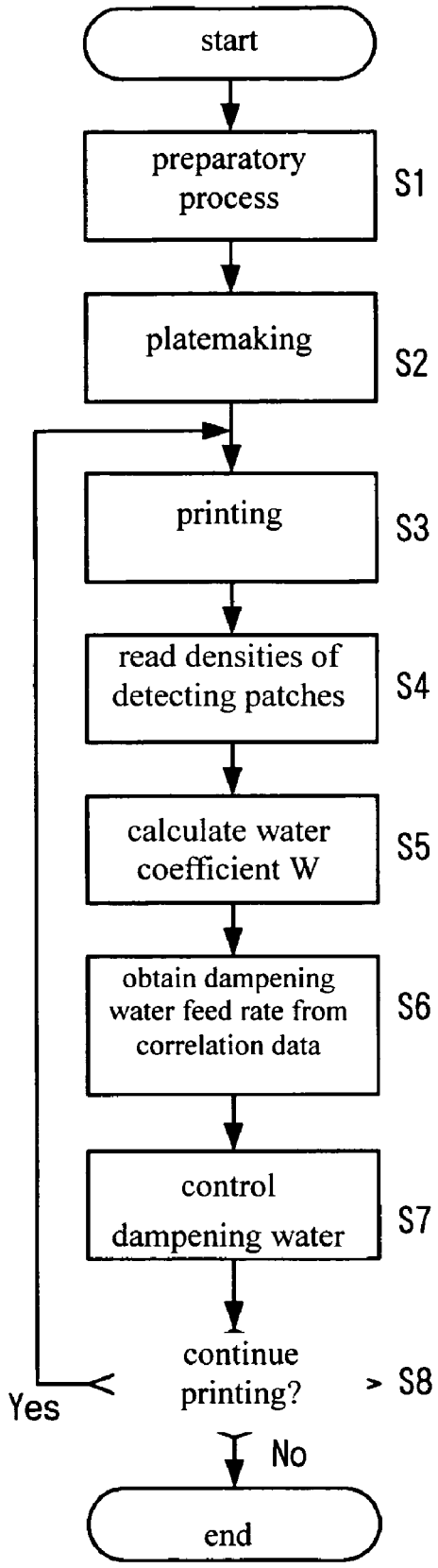
FIG. 9 is a flow chart showing a procedure of a dampening water control method.
Figure 10:
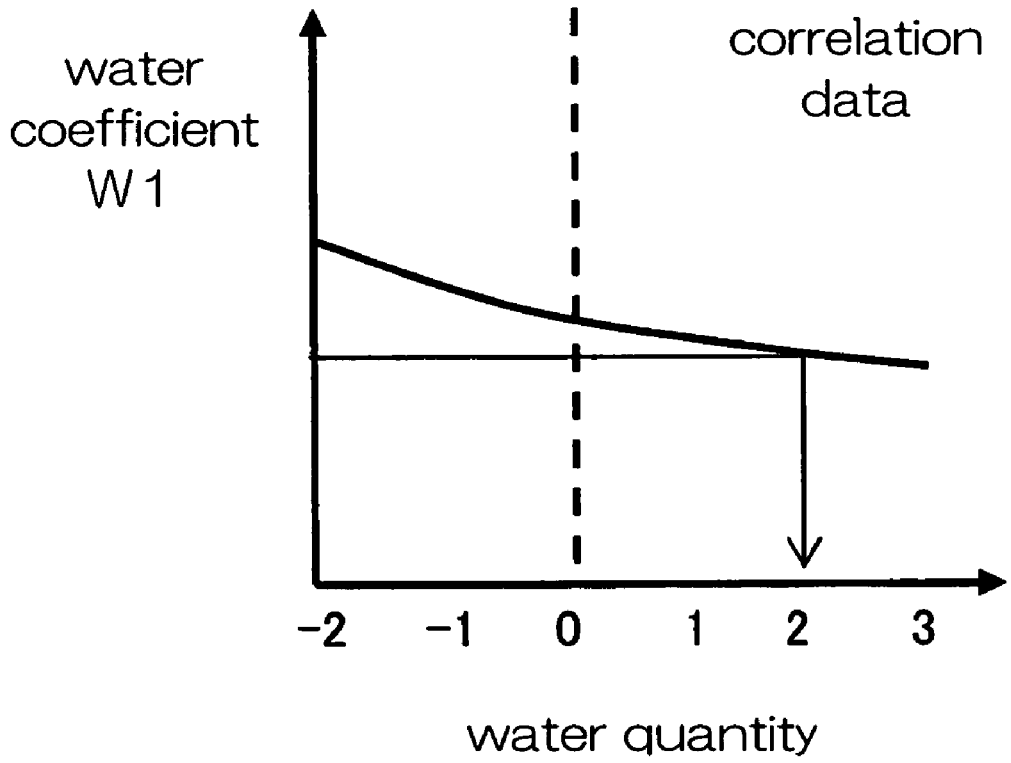
FIG. 10 is a flow chart showing a procedure of determining a feed rate of dampening water from a water coefficient and correlation data.

Next, a dampening water control method in this embodiment will be described with reference to FIGS. 9 and 10. FIG. 9 is a flow chart showing a procedure of the dampening water control method. FIG. 10 is a flow chart showing a procedure of determining a proper feed rate of dampening water from water coefficients W according to the correlation data.

Referring to FIG. 9, step S1 is a preparatory process performed before a production printing operation. In this step, various detecting patches are printed beforehand while changing the feed rate of dampening water, and data of correlation between the feed rate of dampening water and the density of the detecting patches P is created and stored in the correlation data memory 151. The preparatory process in step 1 need not be carried out for every production printing operation, but is done at least once when, for example, the printing apparatus is shipped from the factory. However, it is preferable to create and store correlation data according to printing conditions to be met at each user site.

Steps S2 et seq. are those of a production printing operation. First, in step S2, printing plates are made. This platemaking step may be executed by using the image recorders 35 and 36 included in the printing apparatus as in this embodiment, or by using a separate platemaking apparatus, not shown, provided outside the printing apparatus. In any case, it is essential to create printing plates by affixing to a subject image beforehand the detecting patches P based on the correlation data. In the above embodiment, the detecting patches P are provided for the respective ink key regions. At least one set of detecting patches P is provided for each color printing plate. Preferably, plural sets of detecting patches P are provided as arranged at appropriate intervals transversely of each color printing plate. This is because a distribution of dampening water supplies transversely of the printing direction is not precisely uniform owing to the influence of nip pressures of the water rollers, for example.

In step S3, printing is carried out using the printing plates made in step S2. A feed rate of dampening water for early stages of the printing is set by the operator by referring to a predetermined reference value or a feed rate set the previous time.

After printing a predetermined number of sheets as a start, step S4 is executed to read densities Dm and Ds of detecting patches m and s on the prints. In this embodiment, the image pickup station 60 included in the printing apparatus reads the images of detecting patches m and s from the prints, and the control unit 140 processes their image data into densities. Alternatively, the operator may sample prints, measure densities Dm and Ds of detecting patches m and s with a densimeter or the like, not shown, disposed outside the printing apparatus, and input or transfer data to the control unit 140.

In step S5, the control unit 140 calculates water coefficient W=Dm/Ds from the densities Dm and Ds obtained in step S4. When plural sets of detecting patches are provided on each printing plate in the platemaking process of step S2, water coefficients W calculated for the respective detecting patches m and s are averaged for use, or the highest value of water coefficient W is used. Using the highest value among the plurality of water coefficients W is effective for preventing ink slagging and background scumming due to a shortage of dampening water. It is also possible to perform control to avoid overemulsification of ink due to excessive dampening water by taking a low value of water coefficient W into consideration.

In step S6, the control unit 140 determines a feed rate of dampening water from the correlation data stored in step S1 and the water coefficient W obtained in step S5. When, for example, the correlation data is as shown in FIG. 10 and the value of water coefficient W is W1, the current feed rate of dampening water may be regarded as excessive by 2%. In this case, a correction value of −2% is obtained to realize a proper dampening water feed rate. The control unit 140 may display the result of determination on the control panel 100 that the dampening water is 2% in excess, for the operator to take note and determine a correction value of the dampening water feed rate.

In step S7, the control unit 140 controls the feed rate of dampening water according to the correction value determined in step S6. As noted above, the operator may take note of the result of determination of the current feed rate of dampening water, and manually set a new feed rate of dampening water.

When it is determined in step S8 that the printing operation is to be continued, the operation returns to step S3. Otherwise, this control procedure is ended. Generally, printing density does not vary significantly immediately after control is made of the feed rate of dampening water. This is because the dampening water is transmitted through a plurality of water rollers and the printing plates. It is therefore desirable to execute the process at the above steps S4-S7 at intervals of an appropriate number of prints or at proper time intervals.

In the embodiment described above, the correlation data is prepared beforehand by carrying out a separate printing operation tentatively before a production printing operation. Alternatively, the correlation data may be prepared at the beginning of the production printing operation. This second embodiment will be described hereinafter, in which the apparatus and patches used are the same as in the foregoing embodiment.

First, the operator controls the feed rate of dampening water and observes resulting prints during the production printing operation to obtain proper prints. Then, the density Dm of line patch m and the density Ds of solid patch s are read from a print determined proper by the operator. Water coefficient w (=m/Ds) is calculated from the densities Dm and Ds. In the second embodiment, the value of water coefficient w at this time is stored as reference water coefficient w0. In the second embodiment, only the above reference water coefficient w0 corresponds to the correlation data of this invention. There is no need to prepare data in graph form as shown in FIG. 10.

After obtaining the reference water coefficient w0 from the proper print, the control device controls the feed rate of dampening water for the subsequent printing operation in a way to maintain water coefficient w at the value of the reference water coefficient w0. That is, when the water coefficient w exceeds the reference water coefficient w0, the feed rate of dampening water is increased. When the water coefficient w falls below the reference water coefficient w0, the feed rate of dampening water is decreased. In this way, the feed rate of dampening water may be controlled automatically during the printing operation.

In the second embodiment, the preparatory step in this invention can be carried out at the beginning of the printing step. This provides an advantage of dispensing with the printing operation whose purpose is only to obtain correlation data.

This invention is not limited to the foregoing embodiments, but may be modified in various ways.

This invention may be embodied in other specific forms without departing from the spirit or essential attributes thereof and, accordingly, reference should be made to the appended claims, rather than to the foregoing specification, as indicating the scope of the invention.

This application claims priority benefit under 35 U.S.C. Section 119 of Japanese Patent Application No. 2005-018171 filed in the Japanese Patent Office on Jan. 26, 2005, the entire disclosure of which is incorporated herein by reference.

What is claimed is:

1. A dampening water control method for use in lithographic printing that uses dampening water, for controlling a feed rate of dampening water based on densities of a first detecting patch and a second detecting patch printed with a subject image, the first detecting patch being a solid patch, and the second detecting patch being one of a line patch and a dot patch having at least 200 lines per inch and an image duty ratio of at least 60%, said method comprising:

a preparatory step for printing plural sets of the first and second detecting patches, and determining a relation between a ratio of densities of said plural sets of the first detecting patches and densities of said plural sets of the second detecting patches and the feed rate of dampening water by continuing printing until proper print quality is obtained by adjusting the feed rate of dampening water and ink;

plotting the feed rate of dampening water when the proper print equality is obtained with a corresponding water coefficient W, wherein W=Dm/Ds, where Dm is the density of the second detecting patch and Ds is the density of the first detecting patch;

increasing and decreasing the feed rate of dampening water during printing, and plotting the feed rate of dampening water and the corresponding water coefficient W when the water feed rate is increased or decreased;

and storing the relation as correlation data;

wherein said corresponding W is chosen as a maximal value among values Dm/Ds calculated for corresponding first and second patches of said plural sets at each feed rate of dampening water;

a printing step for printing images of said plural sets of the first detecting patches and said plural sets of the second detecting patches as added to said subject image;

a measuring step for measuring densities of said images of said plural sets of the first detecting patches and said plural sets of the second detecting patches from a print obtained in said printing step;

a calculating step for calculating a ratio of the densities of said images of said plural sets of the first detecting patches and the densities of said images of said plural sets of the second detecting patches as water coefficients Dm/Ds; and a control step for controlling the feed rate of dampening water by selecting a maximum value of the water coefficients from said calculating step, comparing the maximum value of the water coefficients with the relation obtained in the preparatory step to determine whether the feed water rate is insufficient or excessive, and correcting the dampening water feed rate by increasing or decreasing the feed rate of dampening water based on the relation of the preparatory step and a difference between the maximum value of the water coefficients and the water coefficient W at proper print quality.

2. A dampening water control method as defined in claim 1, wherein each of said line patches and said dot patches has at least 300 lines per inch, and an image duty ratio of 60% to 90% according to the number of lines.

3. A printing apparatus for use in lithographic printing that uses dampening water, for controlling a feed rate of dampening water based on densities of a first detecting patch and a second detecting patch printed with a subject image, the first detecting patch being a solid patch, and the second detecting patch being one of a line patch and a dot patch having at least 200 lines and an image duty ratio of at least 60%, said apparatus comprising:

storage means for instructing a printing means to print plural sets of the first and second detecting patches, and determining a relation between a ratio of densities of said plural sets of the first detecting patches and densities of plural sets of the second detecting patches and the feed rate of dampening water by continuing printing until proper print quality is obtained by adjusting the feed rate of dampening water and ink;

plotting the feed rate of dampening water when the proper print equality is obtained with a corresponding water coefficient W, wherein W=Dm/Ds, where Dm is the density of the second detecting patch and Ds is the density of the first detecting patch increasing and decreasing the feed rate of dampening water during printing, and plotting the feed rate of dampening water and the corresponding water coefficient W when the water feed rate is increased or decreased; and storing the relation as correlation data;

means for producing a print with images of said plural sets of the first detecting patches and plurals sets of the second detecting patches printed thereon;

wherein said storage means chooses said corresponding W is chosen as a maximal value among values Dm/Ds calculated for corresponding first and second patches of said plural sets at each feed rate of dampening water;

measuring means for measuring densities of said images of said plural sets of the first detecting patches and said plural sets of the second detecting patches printed on a print;

calculating means for calculating a ratio of the densities of said images of said plural sets of the first detecting patches and the densities of said images of said plural sets of the second detecting patches printed on a print as water coefficients Dm/Ds; and control means for controlling the feed rate of the dampening water by selecting a maximum value of the water coefficients calculated by said calculating means, comparing the maximum value of the water coefficients with the relation stored in said storage means to determine whether the feed water rate is insufficient or excessive, and correcting the dampening water feed rate by increasing or decreasing the feed rate of dampening water based on the relation of the preparatory step and a difference between the maximum value of the water coefficients and the water coefficient W at proper print quality.

4. A printing apparatus as defined in claim 3, wherein each of said line patches and said dot patches has at least 300 lines per inch, and an image duty ratio of 60% to 90% according to the number of lines.

* * * * *